United States Patent [19]

Piesche

[11] Patent Number: 4,466,415

[45] Date of Patent: Aug. 21, 1984

[54] EGR CONTROL SYSTEMS FOR DIESEL ENGINES

[75] Inventor: Gunter Piesche, Ubstadt-Weiher, Fed. Rep. of Germany

[73] Assignee: Ranco Incorporated, Dublin, Ohio

[21] Appl. No.: 535,638

[22] PCT Filed: Mar. 31, 1983

[86] PCT No.: PCT/US82/00407

§ 371 Date: Sep. 19, 1983

§ 102(e) Date: Sep. 19, 1983

[51] Int. Cl.[3] ..... F02M 25/06

[52] U.S. Cl. ..... 123/569; 123/568

[58] Field of Search ..... 123/568, 569

[56] References Cited

U.S. PATENT DOCUMENTS

| | | | |
|---|---|---|---|
| 4,237,837 | 12/1980 | Toda et al. | 123/569 |
| 4,295,456 | 10/1981 | Nomura et al. | 123/569 |
| 4,300,515 | 11/1981 | Straubel et al. | 123/569 |
| 4,416,243 | 11/1983 | Naito et al. | 123/569 |

FOREIGN PATENT DOCUMENTS

| | | | |
|---|---|---|---|
| 2031515 | 5/1980 | United Kingdom | 123/569 |

*Primary Examiner*—Wendell E. Burns

*Attorney, Agent, or Firm*—Watts, Hoffmann, Fisher & Heinke

[57] ABSTRACT

An automotive vehicle having a diesel engine, a throttle system actuable to control the engine speed, a vacuum pump driven by the engine and forming, at least in part, a vacuum pressure source, and an EGR system. The EGR system comprises an EGR valve and a valve controller for governing the level of vacuum pressure communicated to the EGR valve from the vacuum pressure source. The valve controller has a housing defining an output port for supplying operating pressure to the EGR valve, an input port communicating with the vacuum pressure source, and an input port communicating with ambient atmospheric pressure. Regulator valving means in the housing includes a control member movable to control communication between the output port and the input ports to govern the valve operating vacuum pressure level. Throttle position responsive means exerts actuating force on the control member to alter the output pressure. The throttle position responsive means comprises a lever connected to the throttle system, a cam supported by the housing and driven by the lever and a resiliently deflectable force transmitting element between the cam and the control member for applying force to the control member depending on the position of the lever.

6 Claims, 8 Drawing Figures

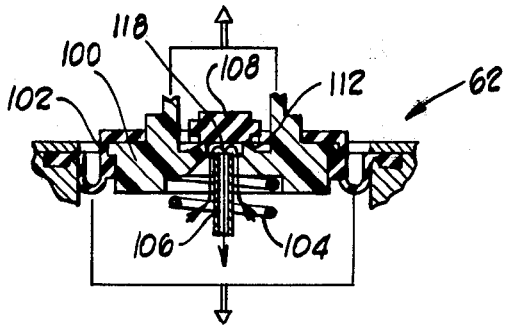
Fig. 4
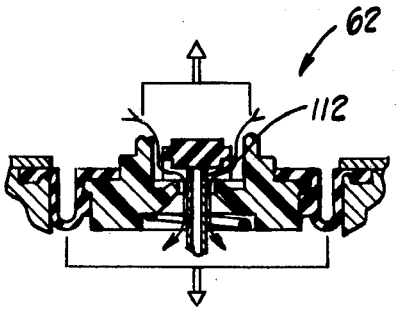
Fig. 5
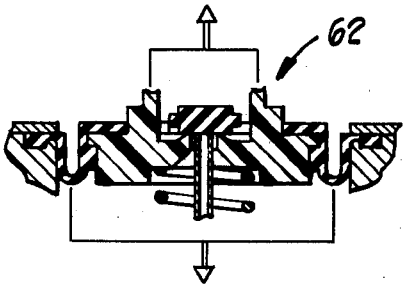
Fig. 6
Fig. 8
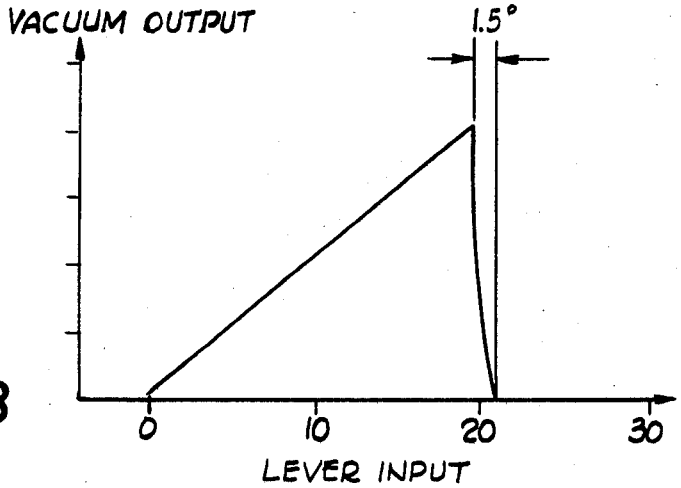

EGR CONTROL SYSTEMS FOR DIESEL ENGINES

DESCRIPTION

1. Technical Field

The present invention relates to exhaust gas recirculation (EGR) and more particularly relates to EGR control systems for use with automotive diesel engines.

2. Background Art

Systems for controlling EGR in spark ignition engines have been in use for many years.

EGR in spark ignition engines reduces the emission of oxides of nitrogen ($NO_x$) from the engines, thus minimizing harm to the environment from these gases. Typical EGR control systems constructed for use with spark ignition engines utilize engine intake manifold vacuum, in one way or another, for providing actuating power for controlling positioning of the EGR valve itself. Because intake manifold vacuum levels are indicative of operating conditions of the engine, the intake manifold vacuum level was also sometimes used by prior art systems as a control parameter tending to indicate the degree of opening of the carburetor throttle valve at a given load. Examples of such EGR control systems are disclosed by U.S. Pat. Nos. 3,884,200; 3,739,797; and 3,970,061, among others.

Diesel engines have not been considered to emit significant amounts of $NO_x$; however, in recent times the amounts of $NO_x$ entering the atmosphere from the exhaust of diesel engines has increased, at least in relative terms, and therefore the use of EGR control valves in diesel engines to reduce $NO_x$ emissions has become desirable.

Diesel engines differ from spark ignition engines in a number of important ways, one being that the diesel engine does not include a valved, or throttled, intake manifold into which the combustion air is induced through a throttle and valve. Diesel engines induce combustion air through manifold-like ducts; but the amount of gas induced is substantially constant in all operating conditions of the engine. Accordingly the vacuum pressure existing in a diesel engine intake duct, is slight at most. The source of vacuum pressure provided by the intake manifold of a spark ignition engine is therefore not available in a diesel engine.

Diesel engines utilized in automotive vehicles are often constructed and arranged to drive small vacuum pumps which form a source of operating vacuum pressure for various pneumatically operated components of the vehicle. The auxiliary vacuum pumps produce vacuum pressure levels adequately great to operate EGR valves for controlling recirculation of engine exhaust gas to the engine intake ducts.

In a diesel engine the engine speed under a given load is controlled by the quantity of fuel injected into the engine combustion chambers and accordingly the "throttle" of the diesel engine is considered to be a manually operated foot pedal connected by a linkage to a fuel pump for supplying the engine fuel injectors. The foot operated pedal is actuated to govern the quantity of fuel delivered by the fuel pump to the combustion chambers of the engine and thus controls the engine speed under a given load.

Since the gas induced into the combustion chamber remains constant while the quantity of fuel introduced into the combustion chamber varies, the production of $NO_x$ varies as a function of throttle setting. This being the case, EGR valves associated with diesel engines can be controlled in relation to operation of the engine throttle.

DISCLOSURE OF THE INVENTION

The present invention provides a new and improved EGR control system for diesel engines wherein the EGR valve is provided with operating pressure varying as a predetermined function of the engine throttle position setting and thus enables close control over the recirculation of exhaust gas in the engine.

In a preferred embodiment of the invention an EGR system for an automotive vehicle diesel engine is provided wherein an EGR valve assembly is operable to recirculate exhaust gas to the engine air intake in relation to the degree of operating vacuum pressure communicated to the EGR valve by an EGR valve controller responsive to the engine throttle position. The EGR valve controller comprises a regulator and a throttle position responsive regulator actuator. The regulator includes a regulator control member movable to control communication between an output port communicating with the EGR valve and input ports communicating with a vacuum pressure source and with atmospheric pressure. The control member is acted upon by differential pressure force between the output port pressure and atmospheric pressure and is also acted upon by actuating force exerted on it by the throttle position responsive actuator. Hence the control member can be stabilized to produce a given output pressure to the EGR valve in response to a given throttle position. The throttle position responsive actuator preferably comprises a lever driven cam and a resiliently deflectable force transmitting element between the cam and the regulator control member for applying force to the control member which depends upon the position of the lever. The force transmitting element changes the force applied to the control member in response to a change in the cam position with the control member moving in response thereto to establish a changed output pressure to the EGR valve at which the forces acting on the control member are again balanced.

The new EGR control system is constructed to be mounted conveniently on the engine or components thereof and is provided in a small yet rugged and inexpensive housing which is communicated to associated parts by small flexible hoses and the like.

Other features and advantages of the invention will become apparent from a consideration of the following detailed description made with reference to the accompanying drawings which form a part of the specification.

BRIEF DESCRIPTION OF DRAWINGS

FIG. 4 is a cross sectional view seen approximately from the plane indicated by the line 4—4 of FIG. 3 with portions broken away;

FIGS. 5 and 6 are views similar to FIG. 4 with parts shown in alternate positions;

DESCRIPTION OF PREFERRED EMBODIMENT

Figure 1:
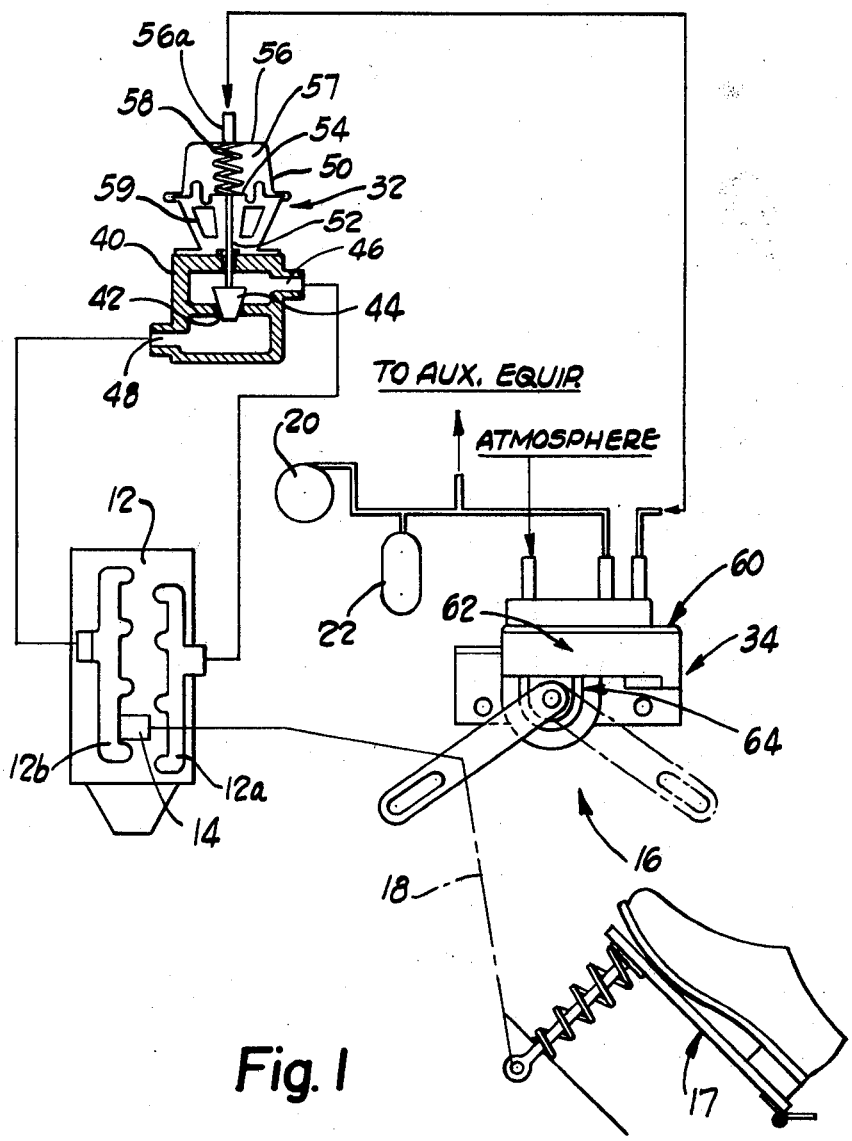
FIG. 1 is a schematic illustration of an EGR control system for an automotive diesel engine embodying the present invention.

An automotive vehicle 10 is partially illustrated in FIG. 1 of the drawings as comprising a diesel engine 12, a fuel pump 14 for supplying fuel to be injected into the engine combustion chambers, and a throttle system 16 for controlling the amount of fuel directed by the pump 14 to the engine. The throttle system 16 is illustrated as comprising a foot-operated pedal 17 and a linkage 18 between the pedal 17 and the fuel pump 14. The vehicle 10 additionally includes a source of actuating vacuum pressure for operating various components associated with the vehicle. In the preferred embodiment an engine driven vacuum pump 20 is associated with a vacuum reservoir tank, or accumulator, 22; the pump and reservoir tank forming the vacuum pressure source. The engine, fuel pump, throttle system, vacuum pump, and reservoir tank may all be of any conventional or suitable construction and therefore are schematically illustrated and not described in detail.

An EGR system 30 constructed according to the invention recirculates controlled amounts of engine exhaust gas from the engine exhaust manifold 12*a* to the engine intake ducts 12*b* as a function of the engine throttle system setting. The EGR system 30 comprises an EGR valve assembly 32 for controlling the EGR flow and an EGR valve controller 34 for governing operation of the EGR valve assembly 32 by supplying controlled operating vacuum pressure to the valve assembly 32 depending upon the condition of the engine throttle system 16.

The EGR valve assembly 32 provides modulated flows of exhaust gas to the engine intake. The assembly 32 is of generally conventional construction and as illustrated by FIG. 1 includes a cross-over valve housing 40 containing a valve seat 42 and a poppet valving member 44 coacting with the seat 42 to control the flow through the valve housing 40. A valve housing inlet port 46 communicates with the exhaust manifold 12*a* and a housing outlet port 48 communicates with the intake duct 12*b*. When the poppet valving member 44 moves from the seat 42 exhaust gas flows through the valve housing 40 to the intake ducts.

The poppet valving member 44 is moved relative to the seat 42 by a vacuum operated valve actuator 50 which positions the poppet valving member 44 to maintain a controlled EGR flow. The valve actuator 50 comprises a poppet stem 52 extending from the valving member 44 through a seal in the wall of the housing 40 to an actuating diaphragm assembly 54. The diaphragm assembly 54 is hermetically attached to the rim of a cup-like housing so that the diaphragm and cup form a chamber 57. A helical compression spring 58 in the chamber 57 reacts between the diaphragm assembly 54 and the cup 56 to bias the valving member 44 toward engagement with the seat 42. The cup 56 is provided with a vacuum port 56*a* through which EGR valve actuating vacuum is communicated from the controller 34.

The diaphragm assembly 54 and cup 56 are supported on the valve housing 40 by a supporting bracket 59 having spoke-like legs which expose the side of the diaphragm assembly 54 opposite the chamber 57 to atmospheric pressure. When vacuum pressure is communicated to the chamber 57 the diaphragm assembly 54 is moved by the applied differential pressure force acting on it against the force of the spring 58 and disengages the poppet valving member 44 from the seat 42. The flow of exhaust gas through the valve housing 40 is controlled by the degree of EGR valve opening which depends upon the level of vacuum pressure in the chamber.

The EGR valve controller 34 is effective to produce output vacuum pressure for actuating the EGR valve assembly 32 from the vehicle vacuum pressure source in relation to operation of the engine throttle system 16. The EGR valve controller 34, illustrated by FIGS. 2–7, comprises a housing assembly 60, a regulator 62 and a regulator actuator 64. The regulator 62 is disposed in the housing 60 in communication with the vehicle vacuum source and the EGR valve assembly. The regulator actuator 64 is supported by the housing and coacts with the throttle system 16 and the regulator 62.

Figure 2:
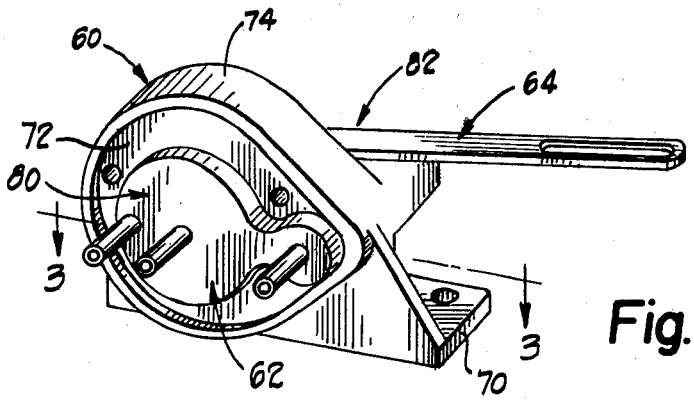
FIG. 2 is a perspective view of an EGR valve controller embodying the invention.
Figure 3:
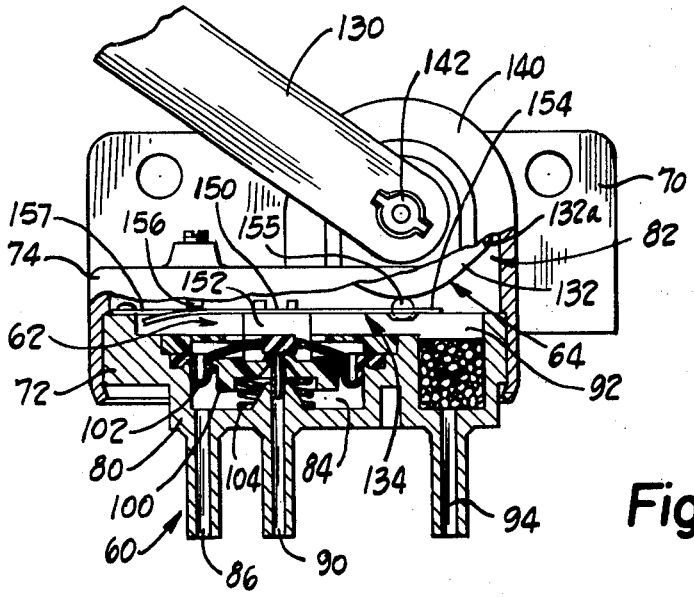
FIG. 3 is a partial cross sectional view seen approximately from the plane indicated by the line 3—3 of FIG. 2 with parts shown in alternate positions.

Referring to FIGS. 2 and 3 the housing assembly 60 comprises a bracket-like support base 70 and a pair of die cast interfitting housing members 72, 74 attached to each other. The housing castings interfit and are preferably assembled together and then staked or crimped to maintain them assembled. The housing assembly thus constructed defines a regulator section 80 and an actuator section 82. The regulator section 80 defines an output pressure chamber 84 communicable with the EGR valve assembly 32 via an output port 86, an input port 90 communicating with the vacuum source, and an atmospheric pressure chamber 92 communicating with ambient atmospheric pressure via an input port 94.

The regulator 62 is disposed in the regulator section 80 and controls communication of the output chamber 84 with the input vacuum and the atmospheric pressure chamber, respectively, to govern the EGR valve operating output pressure produced in the chamber 84 and thus control the position of the EGR valve.

Referring to FIGS. 3–6 the preferred regulator 62 comprises a control member 100 movable to control communication between the output port and the input ports to govern the EGR valve operating pressure level. The illustrated regulator 62 comprises the control member 100, in the form of a movable valve body, a flexible diaphragm 102 supporting the valve body 100, a biasing spring 104 reacting against the valve body 100, a fixed valve body 106, and a valving member 108 coacting with the movable valve body 100 and the fixed valve body 106.

The control member valve body 100 is preferably an annular member defining a central valve body port extending axially through it and a valve seat 112 extending about the port for engagement with the valving member 108.

The fixed valve body 106 is preferably a thin walled rigid tube disposed within the control member valve body port and projecting from the input vacuum port 90 through the output pressure chamber 84. The fixed valve body tube is supported by the housing member 72 and sealed to the housing member to prevent leakage between the input port and the output chamber. The fixed valve body 106 defines an annular valve seat 118 at its projecting end which is sealingly engageable with the valving member 108. The diameter of the fixed valve body tube is smaller than the control member valve body port to permit flow between them.

The valving member 108 is preferably a button-like structure molded integrally with the diaphragm 102 and urged resiliently toward sealing engagement with the seat 112 by narrow tongue-like strips of material (see FIG. 3) continuous with the valving member 108 and the diaphragm 102. The diameter of the member 108 is greater than that of the seat 112 so the member 108 can sealingly engage the seat 112.

The output pressure chamber 84 is alternatively communicable with the input vacuum pressure and the atmospheric pressure chamber 92 to alter the output pressure to the EGR valve assembly 32. When the valve body 100 moves in a direction away from the output chamber 84, as shown by FIG. 4, the valving member 108 is carried by the valve body 100 so that it is and remains sealingly engaged on the seat 112 while being disengaged from the annular seat 118 formed by the end of the fixed valve body 106. This results in direct communication between the vacuum pressure source and the output pressure chamber 84 via the valve body 106 causing reduction of the pressure in the chamber 84 as it is evacuated.

When the control member valve body 100 moves toward the output chamber 84 (see FIG. 5) the valving member 108 sealingly engages the fixed valve body seat 118 so that continued movement of the movable valve body 100 disengages the seat 112 from the valving member 108 causing atmospheric air to flow from the atmospheric pressure chamber 92 through the movable valve body seat 112 and into the output chamber 84.

The position of the movable valve body 100 is determined by forces acting on it applied by the regulator actuator 64, the biasing spring 104 and a feedback force created by differential pressure acting across the valve body 100 and the diaphragm 102 between the chambers 84, 92. The spring 104 biases the valve body 100 away from the chamber 84, tending to cause the valve body seat 112 to lift the valving member 108 away from the seat 118 and communicate the output chamber 84 with the vacuum source. The spring force is opposed by both the regulator actuator force and the feedback force.

The feedback force is created by differential pressure acting on the effective area provided by the diaphragm 102 and the valve body 100. The diaphragm 102 is sealed about its outer perimeter to the housing member 72 and is sealed to the valve body 100 about its inner perimeter. Thus the diaphragm and valve body form a movable wall between the output and atmospheric air chambers so that a feedback force which varies according to output pressure is exerted on the valve body 100.

The regulator actuator and feedback forces are altered relative to each other so that they tend to balance the biasing spring force and the valve body 100 tends to be positioned with the valving member 108 blocking communication between the output chamber 84 and both the vacuum source and the chamber 92.

For example, when the actuator force applied to the valve body 100 increases, tending to move the valve body 100 from the position illustrated by FIG. 6, the regulator output vacuum decreases thus reducing the differential pressure feedback force on the valve body 100 so that the valve body 100 returns to the position illustrated by FIG. 6. If the regulator actuator force is decreased, tending to shift the valve body 100 to its position illustrated by FIG. 4, the regulator output vacuum is increased, increasing the differential pressure feedback force acting on the valve body 100 and resulting in the valve body 100 being again positioned as illustrated by FIG. 6.

The differential pressure feedback force acting on the valve body 100 and the diaphragm 102 thus provides degenerative feedback in the form of a stabilizing force which changes in magnitude to oppose any unbalanced regulator actuator force on the valve body 100 so that the valve body 100 always tends to remain essentially stationary and in the position illustrated by FIG. 6.

Figure 7:
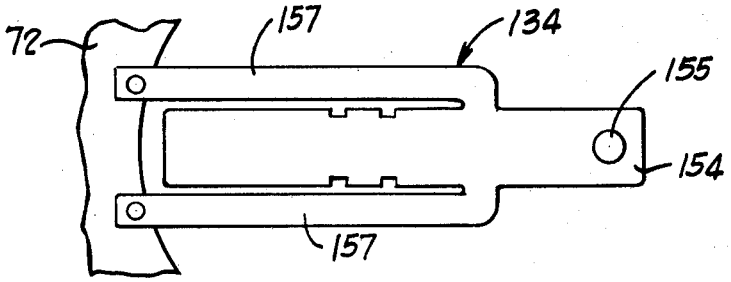
FIG. 7 is a cross section view seen approximately from the plane indicated by the line 7—7 of FIG. 3; and, FIG. 8 is a graphic illustration of operation of a device constructed according to the invention.

The regulator actuator 64 is best illustrated by FIGS. 2, 3 and 7 and provides a controlled actuating force applied to the control member valve body 100 in response to engine throttle system settings to thus control the EGR valving member position. The regulator actuator 64 comprises an engine throttle system engaging lever 130 drivingly connected to a regulator controlling cam 132 which exerts a lever position responsive force on the regulator member 100 via a resilient force transmitting element 134.

As is best illustrated in FIGS. 2 and 3, the housing member 74 is formed with an integral bearing block projection 140 supporting a drive shaft 142 for rotation relative to the housing member. The cam 132 is keyed to the drive shaft 142. One end of the shaft 142 projects from the bearing block 140 and is keyed to the lever 130. The bearing block 140 encloses the cam 132 so that the chamber 92 is not exposed to dirt, dust, etc. present in the environment of the housing 60.

The force transmitting element 134 is preferably a leaf spring having its midsection 150 engaging arms 152 projecting from the regulator member 100 into the atmospheric pressure chamber 92. The ends of the arms 152 are formed with guide projections extending loosely through guide slots in the spring element. The leaf spring element 134 defines a cam follower section 154 projecting cantilever fashion to the cam 132 from the arms 152. The preferred cam follower construction employs a bearing ball 155 seated in a pierced hole formed in the spring material. The ball 155 is trapped between the cam and the spring by the resilient spring forces applied to it. The hardness and wear resistance of the ball 155 assures low friction, abrasion free engagement between the cam and element 134.

The opposite end of the spring element 134 projects cantilever fashion from the arms 152 to a calibration screw 156 which is threaded into the housing member 74 and bears on the spring element 134. The calibration screw is adjusted during manufacture of the valve controller and then sealed in place in the housing member 74.

The spring element 134 is supported in the housing by arms 157 extending parallel to the main body of the spring element and riveted to the housing member 72. The arms 157 are narrow and readily flexible so that they support the spring element in place but do not contribute in any material way to the spring function of the element.

As the throttle system is operated to control the engine speed, the cam 132 is rotated by the lever 130 and drive shaft 142 to vary the force exerted by the leaf spring element 134 on the regulator control member 100. This in turn alters the controller output vacuum communicated to the EGR valve assembly by an amount dependent upon the positioning of the throttle system. When the output vacuum reaches its adjusted level the regulator control member 100 is returned to its position illustrated by FIG. 6 with the leaf spring element 134 deflecting to accommodate the small amount of regulator control member movement required. The spring element 134 is preferably formed from stainless sheet stock so that it is quite stiff.

In the illustrated EGR system the controller output vacuum pressure varies as a function of the throttle system setting in the manner illustrated graphically by FIG. 8. When the throttle is "closed," i.e., when the throttle system is positioned to prevent injection of fuel to the engine, the lever 130 is in an initial (zero degree) position which conditions the regulator against producing any vacuum output to the EGR valve assembly 32. No recirculation of exhaust gas occurs.

As the throttle system is actuated to increase the supply of fuel to the engine, the vacuum output from the EGR valve controller 34 increases essentially as a linear function of the angular lever movement from the initial lever position indicated at 0° on the graph of FIG. 8. The output of the valve controller is set at "zero" vacuum during manufacture by moving the lever 130 to its initial position and advancing the calibration screw 156 against the leaf spring element 134 until the force exerted on the regulator control valving member 100 by the leaf spring 134 overcomes the biasing force of the spring 104 to just move the control valving member to the positon indicated by FIG. 5 of the drawings.

As the lever 130 is moved angularly from its initial position, the force exerted by the cam 132 on the spring element 134 is diminished at a rate determined by the shape of the cam periphery which, in the illustrated embodiment, is shaped to provide for the aforementioned linear increase in output vacuum as a function of angular displacement of the lever 130 from its initial position.

When the throttle approaches its "wide open" position in which the fuel supplied to the engine is nearly maximum, the production of $NO_x$ by the engine is minimum and EGR is neither necessary nor desirable. Accordingly, when the throttle system reaches a predetermined position, the output vacuum from the EGR valve controller is reduced precipitously to zero, resulting in the EGR valve closing and preventing further recirculation. The reduction of output vacuum level is accomplished by a lobe 132*a* on the cam 132 which, when the lever 130 has been rotated, say, 20 degrees from its initial position, is moved into engagement with the leaf spring element 134 causing an abrupt increase in the force exerted by the leaf spring member 134 on the regulator control member. This force increase overcomes the biasing force of spring 104 and results in the regulator control member 100 being positioned as illustrated in FIG. 5, the same as it was when the throttle was closed. The cam lobe 132*a* is configured to exert sufficient force on the leaf element 134 to positively insure the regulator control member 100 remains fixed in its position illustrated by FIG. 5 as the lever 130 continues to be rotated beyond 20 degrees from its initial position.

It should be apparent from the foregoing description that the vacuum output provided by the valve controller 34 can be programmed to vary as any reasonable function of the lever rotation by the throttle system since the valve controller output vacuum can be governed wholly as a function of the shape of the cam 132. Hence, the EGR control system can be used to control EGR in virtually any diesel engine by making relatively minor constructional adjustments primarily to the cam 132.

While a single embodiment of the invention has been illustrated and described herein in considerable detail, the invention is not to be considered limited to the precise construction shown. Various adaptations, modifications and uses of the invention may occur to those skilled in the art to which the invention relates and the intention is to cover hereby all such adaptations, modifications and uses which fall within the scope or spirit of the appended claims.

I claim:

1. In an automotive vehicle having a diesel engine, a throttle system actuable to control the engine speed, a vacuum pump driven by the engine and forming, at least in part, a vacuum pressure source, and an EGR system having an EGR valve assembly operable to recirculate exhaust gas to the engine air intake in relation to the degree of valve operating vacuum pressure communicated thereto and, a valve controller for governing the level of vacuum pressure communicated to the EGR valve from the vacuum pressure source, said valve controller comprising:

(a) a housing defining an output port communicating with the EGR valve for supplying operating pressure thereto, an input port communicating with the vacuum pressure source, and an input port communicating with ambient atmospheric pressure;

(b) a regulator valving means in said housing including a control member movable to control communication between said output port and said input ports to govern the valve operating vacuum pressure level, said control member acted upon by differential pressure force between the output pressure and the pressure at one of said input ports; and, (c) throttle position responsive means for exerting actuating force on said control member which varies as a predetermined function of throttle system operation to alter the output pressure, said throttle position responsive means comprising:

(i) a lever connected to said throttle system;

(ii) a cam supported by said housing and driven by said lever; and, (iii) a resiliently deflectable force transmitting element between said cam and said control member for applying force to said control member depending on the position of said lever, said force transmitting element effective to change the force applied to said control member in response to change in the cam position with said control member moving in response thereto to establish a changed output pressure to said EGR valve at which the forces acting on said control member are balanced.

2. The EGR system claimed in claim 1 wherein said controller comprises a housing defining a lever supporting bearing portion, said cam supported by said bearing portion within said housing.

3. The system claimed in claims 1 or 2 wherein said force transmitting element comprises a resilient spring element extending between said cam and said regulator member and further including an adjustably movable calibration element engageable with said spring element.

4. The system claimed in claim 3 wherein said spring element is a leaf spring having a midsection engaging said regulator member and oppositely extending end portions resiliently engaging said cam and said calibration element, respectively.

5. The system claimed in claim 4 further including a spring member biasing said regulator member against said spring element.

6. The system claimed in claim 5 wherein said cam includes a lobe portion effective to engage said spring element and produce a force on said regulator member which exceeds the force of said spring member for preventing said valve controller from opening said EGR valve when said lever is in a position for maximizing the fuel supplied to the engine.

* * * * *